United States Patent [19]

Ishikawa et al.

[11] 4,456,682

[45] Jun. 26, 1984

[54] SILVER HALIDE COLOR PHOTOGRAPHIC MATERIAL

[75] Inventors: Takatoshi Ishikawa; Akio Mitsui; Masakazu Morigaki; Takashi Nakamura, all of Kanagawa, Japan

[73] Assignee: Fuji Photo Film Co., Ltd., Kanagawa, Japan

[21] Appl. No.: 420,689

[22] Filed: Sep. 21, 1982

[30] Foreign Application Priority Data

Sep. 21, 1981 [JP] Japan ..... 56-149077

[51] Int. Cl.[3] ..... G03C 7/00

[52] U.S. Cl. ..... 430/523; 430/505; 430/539; 430/543; 430/566

[58] Field of Search ..... 430/505, 523, 506, 539, 430/502, 543, 503, 495, 380, 568, 571, 566

[56] References Cited

U.S. PATENT DOCUMENTS

| | | | |
|---|---|---|---|
| 3,620,747 | 11/1971 | Marchant | 430/571 |
| 3,892,572 | 7/1975 | Shiba et al. | 430/504 |
| 3,902,905 | 9/1975 | Bissonette | 430/505 |
| 3,989,527 | 11/1976 | Locker | 430/571 |
| 4,129,446 | 12/1978 | Lohmann et al. | 430/506 |
| 4,229,525 | 10/1980 | Ueda | 430/569 |
| 4,388,401 | 6/1983 | Hasebe et al. | 430/567 |

*Primary Examiner*—Mary F. Downey

*Attorney, Agent, or Firm*—Sughrue, Mion, Zinn, Macpeak & Seas

[57] ABSTRACT

A silver halide color photographic material is disclosed. The material has improved developing characteristics which are obtained by containing both a substantially light-insensitive silver halide and at least one specific 3-pyrazolidone compound. The substantially light-insensitive silver halide includes a halogen composition consisting of 0 to 100 percent of bromide, 0 to 2 percent of iodine and the residual percent of chlorine, a mean grain size of 0.01 to 0.3μ, and a coverage of 5 to 500 mg/m$^2$. The 3-pyrazolidone compound has the following general formula (I):

(I)

wherein X represents a hydrogen atom or an acetyl group; R represents an aryl group; and $R_1$, $R_2$, $R_3$ and $R_4$ each represents a hydrogen atom, an alkyl group or an aryl group, and they may be the same as or different from one another. The material can be developed at an increased speed and is not accompanied by undesirable photographic effects such as fogging.

11 Claims, No Drawings

SILVER HALIDE COLOR PHOTOGRAPHIC MATERIAL

BACKGROUND OF THE INVENTION

This invention relates to a silver halide color photographic material and more particularly, to a silver halide color photographic material with improved developing characteristics.

Various measures have been taken to accelerate the speed of color development. For instance, a wide variety of compounds have been examined with respect to their effectiveness as color developing accelerators as disclosed in U.S. Pat. Nos. 2,950,970; 2,515,147; 2,496,903; 4,038,075 and 4,119,462: British Pat. Nos. 1,430,998 and 1,455,413: published unexamined Japanese Patent Application Nos. 15831/78, 62450/80, 62451/80, 62452/80 and 62453/80: published examined Japanese Patent Application Nos. 12422/76 and 49728/80: and so on. However, most of these compounds have insufficient effects upon acceleration of developing speed, although some of the compounds result in a high degree of accelerating of development such compounds are unsuitable for practical use because they cause fog.

Further, U.S. Pat. Nos. 3,892,572 and 4,129,446; published unexamined Japanese Patent Application No. 14236/81; British Pat. No. 1,378,577; and so on have reported that developing speed can be accelerated by providing, in a sensitive material, and emulsion layer containing substantially light-insensitive silver halide. Therein, the substantially light-insensitive silver halide emulsion layer functions so as to adsorb useless halogens released during development and development-inhibiting substances such as useless groups separated from a DIR coupler or a DAR coupler at the time of development. Therefore, the compounds themselves do not have a positive developing-acceleration effect. Therefore, they have little effect upon acceleration of development.

Furthermore, published unexamined Japanese Patent Application No. 64399/81 describes that color development can be accelerated by means of addition of 3-pyrazolidones to a silver halide color photographic material. However, the accelerating effect attainable by this means is still insufficient.

SUMMARY OF THE INVENTION

An object of the present invention is to provide a silver halide color photographic material whose color image can be developed at a greatly accelerated speed.

More specifically a primary object of the present invention is to provide a silver halide color photographic material which can form colors with sufficiently high densities in a short time without being accompanied by deterioration of photographic properties, especially generation of fog and change of image tone into lower contrast.

As a result of examining various means for accelerating color development, it has now been found that the above-described objects can be effectively attained by incorporating both a substantially light-insensitive silver halide and at least one particular 3-pyrazolidone compound having the general formula (I) described hereinafter into a silver halide color photographic material. That is, these two means for accelerating the speed of development produce an improved unexpected great synergistic effect when used in combination, though they exercise insufficient effects upon acceleration of development when used independently.

DETAILED DESCRIPTION OF THE INVENTION

The silver halide emulsion of the present invention is substantially light-insensitive. The halogen composition of the emulsion is 0 to 100% bromide 0 to 2% iodine and the residual percent is chlorine (Cl may be 0%). Preferably, iodine is 0%. The substantially light-insensitive silver halide is present in the emulsion in the form of fine grains, and an average grain size thereof ranges from 0.01 to 0.3$\mu$, preferably from 0.01 to 0.1$\mu$. In addition, the coverage thereof per one layer ranges from 5 to 500 mg/m$^2$, preferably from 10 to 100 mg/m$^2$.

The substantially light-insensitive silver halide can be incorporated in any of the constituent layers of the sensitive material.

When the substantially light-insensitive silver halide is to be incorporated in a light-sensitive silver halide emulsion layer, it is preferable to employ the following layers:

(i) a layer in which the development proceeds slowly (e.g., a development inhibitor producing layer or the like)

(ii) a layer which contains silver halide grains having the largest grain size (e.g., a blue-sensitive emulsion layer in color paper, or the like), (iii) a layer in which the silver halide has the smallest chlorine content, and so on.

It is, in general more preferable to employ the substantially light-insensitive silver halide in a hydrophilic colloidal layer which does not contain any light-sensitive silver halide and is disposed on the side of the support with light-sensitive silver halide emulsion layers. For example, if it is employed in the topmost layer or a protective layer, the substantially light-insensitive silver halide can prevent the elution of halogens, development inhibitor and the like from moving from the sensitive material into the developing solution. Accordingly, variations in developability due to eluted substances can be suppressed.

Most advantageously, the substantially light-insensitive silver halide is employed in a hydrophilic colloidal layer adjacent to the silver halide emulsion layer corresponding to one of the above-described layers (i) to (iii).

The expression "substantially light-insensitive silver halide" used in this invention is intended to include silver halides which do not have any practical sensitivities, that is, silver halides which have not received any chemical sensitizations (including sulfur sensitization, gold sensitization reduction sensitization and so on) or has received very little chemical sensitization, or silver halides made up of fine grains having an average size of 0.3$\mu$ or less (preferably 0.1$\mu$ or less). These silver halides can be easily prepared according to known methods as described in P. Glafkides; *Chimie et Physique Photographique,* Paul Montel, Paris (1967), G. F. Diffin; *Photographic Emulsion Chemistry,* The Focal Press, London (1966), V. L. Zelikman et al.; *Making and Coating Photographic Emulsion,* The Focal Press, London (1964), and so on.

The 3-pyrazolidone compounds used in the sensitive material of this invention have the following general formula (I).

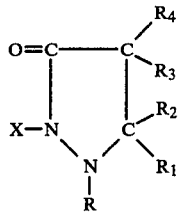

(I)

wherein X is a hydrogen atom or an acetyl group; R is an aryl group; and $R_1$, $R_2$, $R_3$ and $R_4$ each represents a hydrogen atom, an alkyl group or an aryl group, and they may be the same as or different from one another.

An acetyl group represented by X in the general formula (I) may have a certain substituent. For example, the acetyl group may be an acetyl group substituted with an alkyl group having preferably 1 to 4 carbon atoms (e.g., methyl, ethyl or like groups). However, X is preferably a hydrogen atom.

Aryl groups represented by R in the general formula (I) include a phenyl group, a naphthyl group, a tolyl group, a xylyl group or the like. Of these groups, a phenyl group is particularly advantageous. These groups may have certain substituents. Specifically, the aryl groups may be substituted with halogen atoms (e.g., chlorine atom, bromine atom, etc.), alkyl groups having preferably 1 to 20 carbon atoms (e.g., methyl group, ethyl group, propyl group, etc.), alkoxy groups having preferably 1 to 20 carbon atoms (e.g., methoxy group, ethoxy group, etc.), sulfonyl group, amido groups having preferably 1 to 20 carbon atoms (e.g., methylamido group, ethylamido group, etc.) or so on.

Suitable alkyl groups represented by $R_1$, $R_2$, $R_3$ and $R_4$ in the general formula (I) include those having 1 to 10 carbon atoms (e.g., methyl group, ethyl group, propyl group, butyl group, etc.), and they may be substituted with hydroxyl groups, amino groups, acyloxy groups having preferably 1 to 20 carbon atoms and so on. Suitable aryl groups represented by the above-described substituents include phenyl groups, naphthyl group, xylyl groups, tolyl groups and the like. Of these groups, phenyl groups are particularly advantageous. The above-described aryl groups may be substituted with halogen atoms (e.g., chlorine atom, bromine atom, etc.), alkyl groups having preferably 1 to 5 carbon atoms (e.g., methyl group, ethyl group, propyl group, etc.), alkoxy groups having preferably 1 to 5 carbon atoms (e.g., hydroxy group, methoxy group, ethoxy group, etc.) or so on.

$R_1$, $R_2$, $R_3$ or $R_4$ in the compounds employed advantageously in this invention is an aryl group, or an alkyl group (having preferably 1 to 5 carbon atoms) substituted with an acyloxy group. More preferably, $R_1$–$R_4$ represent a phenyl group. Particularly advantageous compounds in this invention are those having a phenyl group as $R_1$ or $R_2$, and those having an acyloxy group as $R_3$ or $R_4$.

Specific examples of the compounds represented by the general formula (I) are illustrated below:

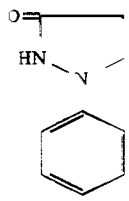

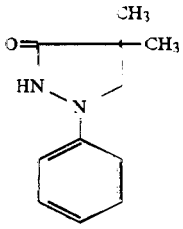

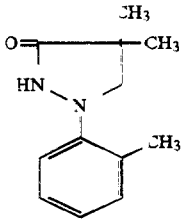

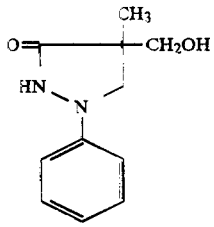

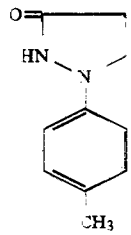

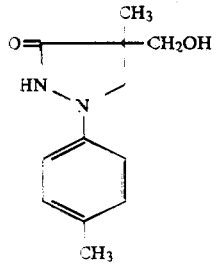

-continued
I-7
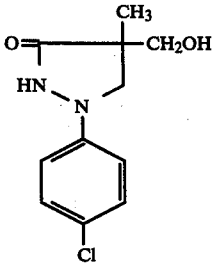
I-8
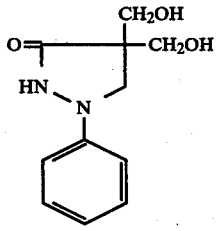
I-9
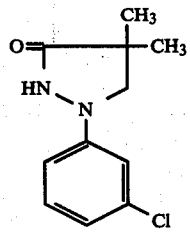
I-10
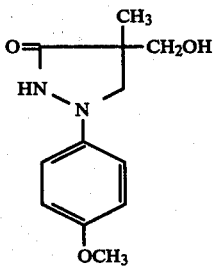
I-11
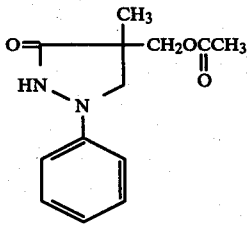
I-12
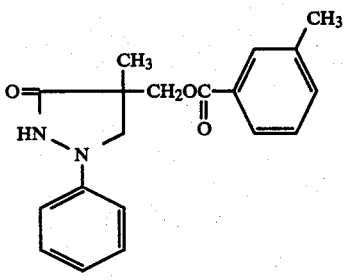
-continued
I-13
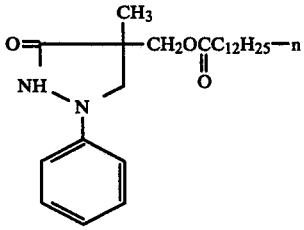
I-14
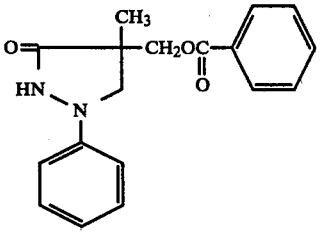
I-15
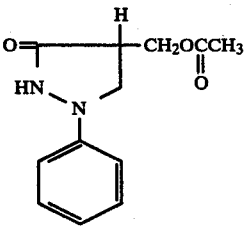
I-16
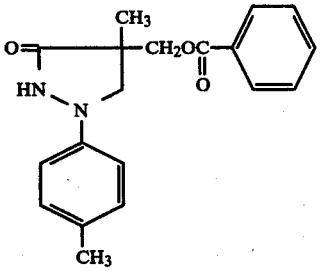
I-17
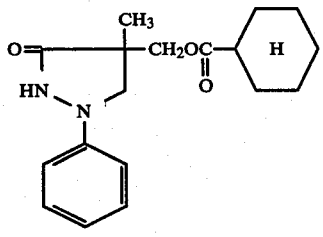
I-18
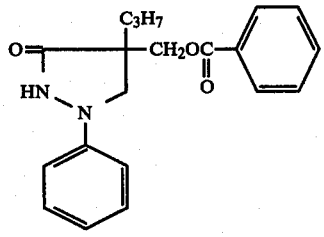

-continued
I-19
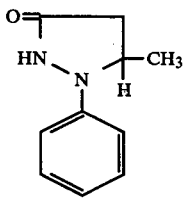
I-20
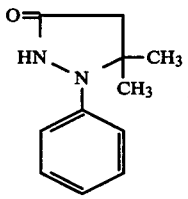
I-21
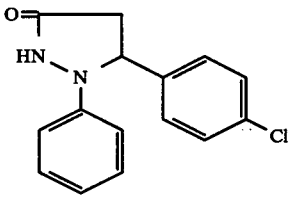
I-22
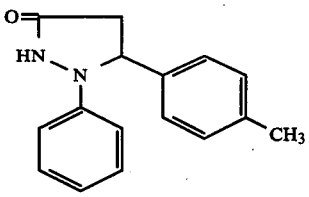
I-23
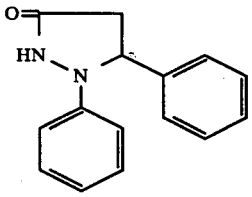
I-24
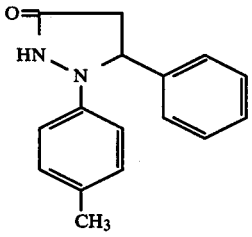
I-25
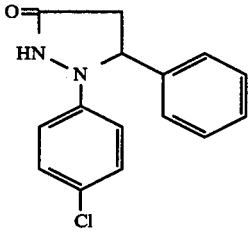
-continued
-26
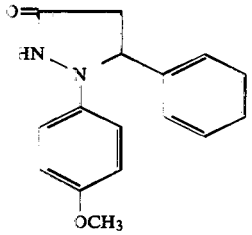
-27
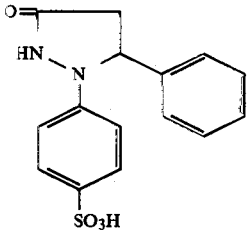
-28
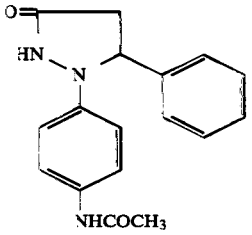
-29
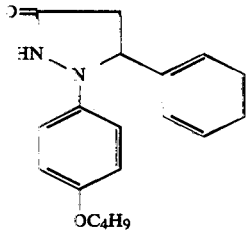
-30
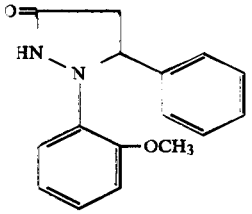
-31
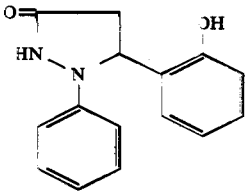
-32
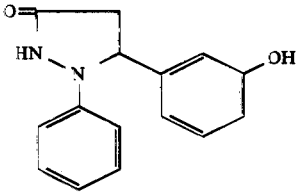

-continued
I-33
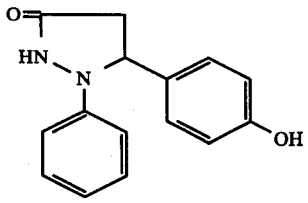
I-34
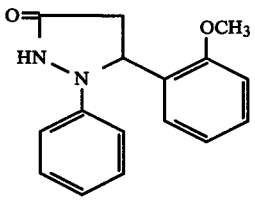
I-35
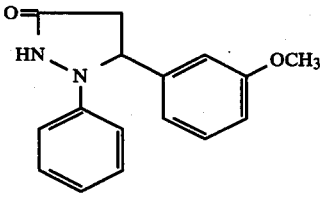
I-36
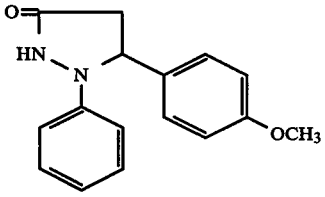
I-37
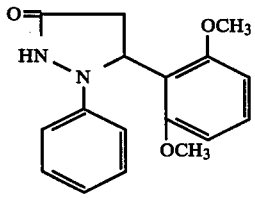
I-38
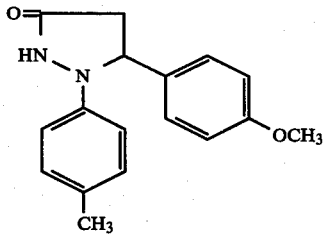
I-39
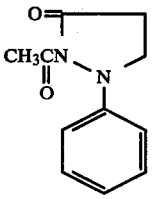
-continued
I-40
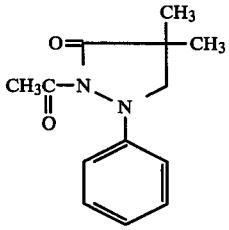
I-41
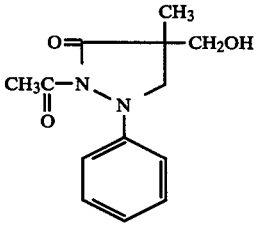
I-42
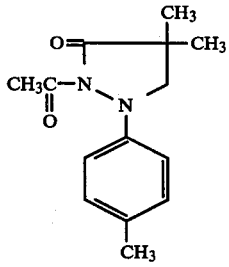
I-43
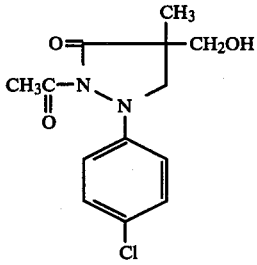
I-44
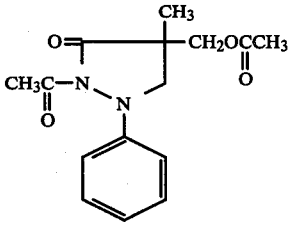
I-45
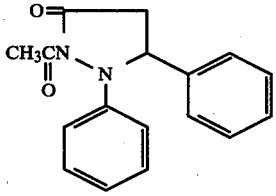

-continued

I-46

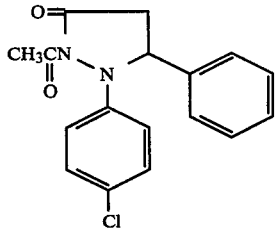

Of the above-illustrated typical compounds, I-13, I-14, I-16, I-17, I-18, I-23, I-24, I-25, I-26, I-34, I-35, I-36 and I-38 are employed to greater advantage in this invention.

The compounds of this invention, some of which are on the market, can be synthesized according to the methods described in U.S. Pat. Nos. 2,688,024 and 2,704,762 (incorporated herein by reference to disclose methods of making these compounds); and published unexamined Japanese Patent Application No. 64339/81.

Typical synthesis examples of the compounds of this invention are described in detail below.

SYNTHESIS EXAMPLE 1

Synthesis of Compound I-12

In a 1 liter 4-necked flask, 300 ml of acetonitrile was added to 41.2 g of 4-hydroxymethyl-4-methyl-1-phenyl-3-pyrazolidone. The temperature of the inside of a flask was maintained at 10° C. by cooling the outside with a bath of ice water 31.0 g of benzoylchloride was slowly added to the flask dropwise in a stream of nitrogen with stirring. After 30 minutes of dropwise addition, the outer bath was taken away, and stirring was further continued for 3 hours at a room temperature. The reaction mixture was then allowed to stand for 24 hours in an atmosphere of nitrogen. It was concentrated, evaporated to dryness, dissolved in ethyl acetate, washed with 3% $NaHCO_3$ aqueous solution and further, washed with water. Thereafter, the ethyl acetate phase was dried with Glauber's salt, concentrated, evaporated to dryness, crystallized from a methanol/water mixed solvent and further, recrystallized from a n-hexane/ethyl acetate mixed solvent, m.p. 158.5°-160.0° C. Yield was 10.5 g. It was supported from measurements of NMR and IR and further, from the result of elemental analysis that the compound obtained has the intended chemical structure.

SYNTHESIS EXAMPLE 2

Synthesis of Compound I-24

A mixture of 22.2 g of 4-methylphenylhydrazine hydrochloride, 1.5 g of tert-butylhydroquinone, 67.5 ml of methanol containing sodium methoxide in a concentration of 28%, and 250 ml of n-butanol was heated with stirring in a stream of nitrogen gas. After the methanol was distilled away, 29.6 g of ethyl cinnamate was dropwise added thereto over a period of 30 minutes. It was heated for 2 hours with stirring while n-butanol was being distilled away therefrom under ordinary pressure. After cooling, the reaction mixture was neutralized with an aqueous solution of hydrochloric acid, and extracted with ethyl acetate. The extract was washed with water, and dried with anhydrous magnesium sulfate. After the solvent was distilled away, the product was crystallized from ethyl acetate. Yield was 7.7 g, and melting point was 156°-158° C.

Elemental analysis for compound I-24 ($C_{16}H_{16}N_2O$): Calc'd: C, 76.17%; H, 6.39%; N, 11.10%: Found: C, 76.20%; H, 6.19%; N, 11.07%.

SYNTHESIS EXAMPLE 3

Synthesis of Compound I-32

A mixed solution of 18 g of phenyl hydrazine, 1.0 g of tert-butylhydroquinone, 50.2 ml of a 28% methanol solution of sodium methoxide and 250 ml of n-butanol was heated with stirring in a stream of nitrogen gas. After the methanol was distilled away, 100 ml of n-butanol solution containing 32 g of ethyl m-hydroxycinnamate was added dropwise over a period of 30 minutes. The reaction mixture was heated for 3 hours with stirring while n-butanol was being distilled away under ordinary pressure. Then, it was cooled, neutralized with an aqueous solution of hydrochloric acid, extracted with n-butanol and washed with a saturated aqueous solution of sodium chloride. The extract was dried with anhydrous magnesium sulfate, and the solvent was distilled away therefrom. The product was recrystallized from a methanol/n-hexane (2:1) mixed solvent. Yield was 14.1 g, and melting point was 188°-189.5° C.

Elemental analysis for compound I-32 ($C_{15}H_{14}N_2O_2$): Calc'd: C, 70.85%; H, 5.55%; N, 11.01%: Found: C, 70.84%; H, 5.43%; N, 11.17%.

SYNTHESIS EXAMPLE 4

Synthesis of Compound I-35

A mixed solution of 19.4 g of phenyl hydrazine, 1.6 g of tert-butylhydroquinone, 60.3 ml of a 28% methanol solution of sodium methoxide and 250 ml of n-butanol was heated with stirring in a stream of nitrogen gas. After the methanol was distilled away, 100 ml of a n-butanol solution containing 41.2 g of ethyl m-methoxycinnamate was added dropwise over a period of 30 minutes. The reaction mixture was heated for 1 hour with stirring while n-butanol was being distilled away therefrom under an ordinary pressure. Then, it was cooled, and neutralized with an aqueous solution of hydrochloric acid. The product was extracted with n-butanol, washed with a saturated aqueous solution of sodium chloride, and dried with anhydrous magnesium sulfate. The solvent was distilled away, and the solid residue was recrystallized from methanol. Yield: 30 g. Melting point: 164°-166° C.

Elementary analysis for compound I-35 ($C_{16}H_{16}N_2O_2$): Calc'd: C, 71.62%; H, 6.01%; N, 10.44%: Found: C, 71.61%; H, 5.95%; N, 10.56%.

The compound represented by the general formula (I) is added in an amount of 0.001 to 1 mole, and preferably 0.005 to 0.5 mole, per mole of silver halide. The compound represented by the general formula (I) may be added to any of the emulsion layers (blue-sensitive layers, green-sensitive layers and red-sensitive layers) or all of the emulsion layers. Further, it may be added to a layer adjacent to an emulsion layer. In general, it is preferable to add the compound to a subbing layer, the lowest layer adjacent to the subbing layer, or the lowest layer in the emulsion layers.

The compound, is preferably added by dispersing it directly in an emulsion layer, or dispersing it into gelatin or an emulsion after dissolving it in water or an alcohol.

Suitable examples of color photographic materials to which this invention can be applied include all color photographic materials which utilize color-development processing, e.g., color papers, color negative films, color reversal films and so on. However, the advantages of the invention are most noticeable in connection with sensitive materials used for prints.

A subbing layer of the photographic material which can be employed in this invention is a hydrophilic colloidal layer comprised of hydrophilic high polymers like gelatins (suitable examples of which include binders and protective colloids for photographic emulsions described hereinafter). The subbing layers are usually placed on a support with a conventional coating technique. In general, the subbing layer is provided for the purpose of heightening adhesiveness to the photographic emulsion layer to be provided on the support, or preventing halation from occurring.

Photographic emulsions useful in connection with this invention can be made using various processes as described in P. Glafkides; *Chimie et Physique Photographique,* Paul Montel, Paris (1967), G. F. Diffin; *Photographic Emulsion Chemistry,* The Focal Press, London (1966), V. L. Zelikman et al.; *Making and Coating Photographic Emulsion,* The Focal Press, London (1964), and so on. In general, any known process may be used including the acid process, the neutral process and the ammonia process. Useful methods for reacting a water-soluble silver salt with a water-soluble halide include a single jet method, a double jet method, and combinations thereof.

It is also possible to use a method in which silver halide grains are produced in the presence of excess silver ion (the so-called inverted jet method). Another method which can be used in the so-called controlled double jet method, in which the pAg of the liquid phase in which silver halide grains are to be precipitated is maintained constant.

According to this method, a silver halide emulsion having a regular crystal form and an almost uniform grain size can be obtained.

Two or more of silver halide emulsions produced separately may be employed in a mixed form.

Silver halides which may be employed in a photographic emulsion layer of the photographic material of this invention include silver bromide, silver iodobromide, silver iodochlorobromide, silver chlorobromide, and silver chloride.

When producing the silver halide grains or allowing the produced silver halide grains to ripen physically, cadmium salts, zinc salts, lead salts, thallium salts, iridium salts or complexes, rhodium salts or complexes, iron salts or complexes and/or the like may be present.

The photographic emulsion of this invention may be spectrally sensitized with methine dyes or so on. Examples of dyes which can be employed include cyanine dyes, merocyanine dyes, complex cyanine dyes, complex merocyanine dyes, holopolar cyanine dyes, hemicyanine dyes, styryl dyes and hemioxonol dyes. Of these dyes, particularly useful dyes are those belonging to a class of cyanine dyes, a class of merocyanine dyes and a class of complex merocyanine dyes. To these dyes, it is possible to apply any nuclei which are usually present as basic heterocyclic nuclei in cyanine dyes. Specific examples of such nuclei include a pyrrolidine nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; nuclei formed by the above-described nuclei and alicyclic hydrocarbon rings being fused together; and nuclei formed by the above-described nuclei and aromatic hydrocarbon rings being fused together, with specific examples including an indolenine nucleus, a benzindolenine nucleus, an indole nucleus, a benzoxazole nucleus, a naphtoxazole nucleus, a benzothiazole nucleus, a naphtothiazole nucleus, a benzoselenazole nucleus, a benzimidazole nucleus, a quinoline nucleus and the like. These nuclei may be substituted on carbon atoms.

In merocyanine dyes or complex merocyanine dyes, 5- or 6-membered heterocyclic nuclei, such as pyrazoline-5-one nuclei, thiohydantoin nuclei, 2-thiooxazolidine-2,4-dione nuclei, thiazolidine-2,4-dione nuclei, rhodanine nuclei, thiobarbituric acid nuclei and the like, can be employed as nuclei having a ketomethylene structure.

Useful sensitizing include those described in, e.g., German Pat. No. 929,080: U.S. Pat. Nos. 2,231,658; 2,493,748; 2,503,776; 2,519,001; 2,912,329; 3,656,959; 3,672,897; 3,694,217; 4,025,349 and 4,046,572: British Pat. No. 1,242,588: and published examined Japanese Patent Applications 14030/69 and 24844/77.

These sensitizing dyes may be used independently or in combination. Combinations of sensitizing dyes are often employed especially for the purpose of supersensitization. Typical examples of supersensitizing combinations are described in U.S. Pat. Nos. 2,688,545; 2,977,229; 3,397,060; 3,522,052; 3,527,641; 3,617,293; 3,628,946; 3,666,480; 3,672,898; 3,679,428; 3,703,377; 3,769,301; 3,814,609; 3,837,862 and 4,026,707: British Pat. Nos. 1,344,281 and 1,507,803: published examined Japanese Patent Applications 4936/68 and 12375/78: and published unexamined Japanese Patent Applications 110618/77 and 109925/77.

Materials which can exhibit a supersensitizing effect in a combination with a certain sensitizing dye though they themselves do not spectrally sensitize silver halide emulsions or do not absorb light in the visible region may be incorporated in the silver halide emulsions of this invention. For example, aminostilbene compounds substituted with nitrogen-containing heterocyclic groups (for instance, as described in U.S. Pat. Nos. 2,933,390 and 3,635,721), aromatic organic acid-formaldehyde condensates (for instance, as described in U.S. Pat. No. 3,743,510), cadmium salts, azaindene compounds and so on can be used. Particularly useful combinations are disclosed in U.S. Pat. Nos. 3,615,613; 3,615,641; 3,617,295 and 3,635,721.

Gelatin is preferably used as the binder or protective colloid of the photographic emulsion of this invention. However, hydrophilic colloids, other than gelatin, can be also employed.

For example, proteins such as gelatin derivatives, graft polymers prepared from gelatin and other high polymers, albumin, casein and the like; sugar derivatives including cellulose derivatives, such as hydroxymethyl cellulose, carboxymethyl cellulose, cellulose sulfate and the like, sodium alginate, starch derivatives and so on; and various kinds of synthetic hydrophilic macromolecular substances such as homo- or co-polymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole and the like can be employed.

Useful gelatins include not only lime processed gelatin but also acid processed gelatin and enzyme processed gelatin as described in *Bull. Soc. Sci. Phot. Japan*, No. 16, p. 30 (1966) may be used. In addition, hydrolysis products and enzymatic degradation products of gelatin can be also used.

Gelatin derivatives which can be used include those obtained by reacting gelatin with various kinds of compounds, for example, acid halides, acid anhydrides, isocyanates, bromoacetic acid, alkane sultones, vinylsulfonamides, maleinimide compounds, polyalkyleneoxides, epoxy compounds and so on. Specific examples of these gelatin derivatives are described in U.S. Pat. Nos. 2,614,928; 3,132,945; 3,186,846 and 3,312,553: British Pat. Nos. 861,414; 1,033,189 and 1,005,784: published examined Japanese Patent Application No. 26845/67: and so on.

Gelatin graft polymers which can be used include those obtained by grafting on gelatin homo- or copolymers of vinyl monomers, such as acrylic acid, methacrylic acid, their esters, amides and other derivatives, acrylonitrile, styrene and so on. Of these graft polymers, those produced by grafting on gelatin polymers having some degrees of compatibilities with gelatin, e.g., polymers containing as constitutional repeating units acrylic acids, methacrylic acid, acrylamide, methacrylamide, an hydroxyalkylmethacrylate and/or the like, are particularly desirable. Specific examples of these graft polymers are described in U.S. Pat. Nos. 2,763,625; 2,831,767 and 2,956,884: and so on.

Typical examples of synthetic hydrophilic macromolecular substances are described in, for example, German Patent Application (OLS) No. 2,312,708: U.S. Pat. Nos. 3,620,751 and 3,879,205: and published examined Japanese Patent Application No. 7561/68.

This invention can be also applied to a multilayer multicolor photographic material having at least two different spectral sensitivities on its support. A multilayer color photographic material generally has on a support at least one red-sensitive emulsion layer, at least one green-sensitive emulsion layer and at least one blue-sensitive emulsion layer. The coating order of these layers can be arbitrarily selected depending on the occasion. In a usual color photographic material, the red-sensitive emulsion layer contains a cyan color-forming coupler, the green-sensitive emulsion layer contains a magenta color-forming coupler, and the blue-sensitive emulsion layer contains a yellow color-forming coupler. However, combinations, other than the above-described one, can also be adopted as circumstances require.

Sensitive materials made in accordance with embodiments of this invention may contain water-soluble dyes in their hydrophilic colloidal layers as a filter dye, for the purpose of prevention from irradiation, or for other various purposes. Examples of such water-soluble dyes include oxonol dyes, hemioxonol dyes, styryl dyes, merocyanine dyes, cyanine dyes and azo dyes. Of these dyes, oxonol dyes, hemioxonol dyes and merocyanine dyes are more useful. Specific examples of these dyes which can be employed are described in British Pat. Nos. 584,609 and 1,177,429: published unexamined Japanese Patent Application Nos. 85130/73, 99620/74, 114420/74 and 108115/77: and U.S. Pat. Nos. 2,274,782; 2,553,472; 2,956,879; 3,148,187; 3,177,078; 3,247,127; 3,540,887; 3,575,704; 3,653,905; 3,718,472; 4,071,312 and 4,070,352.

In embodying this invention, known discoloration inhibitors described below can be used jointly, and dye stabilizers to be employed can be used individually or in combination of two or more thereof. Examples of known discoloration inhibitors include hydroquinone derivatives as described in U.S. Pat. Nos. 2,360,290; 2,418,613; 2,675,314; 2,701,197; 2,704,713; 2,728,659; 2,732,300; 2,735,765; 2,710,801 and 2,816,028: British Pat. No. 1,363,921: and so on, gallic acid derivatives as described in U.S. Pat. Nos. 3,457,079 and 3,069,262: and so on, p-alkoxyphenols as described in U.S. Pat. Nos. 2,735,765 and 3,698,909: and published examined Japanese Patent Application Nos. 20977/74 and 6623/77, p-oxyphenol derivatives as described in U.S. Pat. Nos. 3,432,300; 3,573,050; 3,574,627 and 3,764,337: and published unexamined Japanese Patent Applications 35633/77, 147434/77 and 152225/77, bisphenols as described in U.S. Pat. No. 3,700,455, and so on.

Sensitive materials made in accordance with embodiments of this invention may contain as a color fog inhibitor hydroquinone derivatives, aminophenol derivatives, gallic acid derivatives, ascorbic acid derivatives and so on. Specific examples of such color fog inhibitors are described in U.S. Pat. Nos. 2,360,290; 2,336,327; 2,403,721; 2,418,613; 2,675,314; 2,701,197; 2,704,713; 2,728,659; 2,732,300 and 2,735,765: published unexamined Japanese Patent Application Nos. 92988/75, 92989/75, 93928/75, 110337/75 and 146235/77: published examined Japanese Patent Application 23813/75: and so on.

Sensitive materials made in accordance with embodiments of this invention may contain ultra violet absorbing agents in their hydrophilic colloidal layers. Examples of ultra violet absorbing agents which can be employed include benzotriazole compounds substituted with aryl groups (as described in, for example, U.S. Pat. No. 3,533,794), 4-thiazolidone compounds (as described in, for example, U.S. Pat. Nos. 3,314,794 and 3,352,681), benzophenone compounds (as described in, for example, published unexamined Japanese Patent Application 2784/71), cinnamic acid ester compounds (as described in, for example, U.S. Pat. Nos. 3,705,805 and 3,707,375), butadiene compounds (as described in, for example, U.S. Pat. No. 4,045,229), and benzoxazole compounds (as described in, for example, U.S. Pat. No. 3,700,455). In addition, the compounds described in U.S. Pat. No. 3,499,762 and published unexamined Japanese Patent Application No. 48535/79 can also be employed. Further, ultra violet absorbing couplers (e.g., cyan dye forming couplers of α-naphthol type) and ultra violet absorbing polymers may also be employed. These ultra violet absorbing agent may be mordanted in specific layers.

Sensitive materials made in accordance with embodiments of this invention may contain brightening agents of the stilbene type, triazine type, oxazole type, coumarine type or the like in their photographic emulsion layers or other hydrophilic colloidal layers. Such an agent may be a water-soluble one, or water-insoluble one. When it is water-insoluble, it is used in the form of a dispersion. Specific examples of the brightening agents are described in U.S. Pat. Nos. 2,632,701; 3,269,840 and 3,359,102: British Pat. Nos. 852,075 and 1,319,763: and so on.

Photographic emulsion layers of the photographic material of this invention contain couplers capable of forming colors by oxidative coupling reactions with aromatic primary amine developers (e.g., phenylenediamine derivatives, aminophenol derivatives and the like) when subjected to color development-processing.

Examples of magenta couplers which can be employed include those described in U.S. Pat. Nos. 2,600,788; 2,983,608; 3,062,653; 3,127,269; 3,311,476; 3,419,391; 3,519,429; 3,558,319; 3,582,322; 3,615,506; 3,834,908 and 3,891,445: German Pat. No. 1,810,464: German Patent Application (OLS) Nos. 2,408,665; 2,417,945; 2,418,959 and 2,424,467: published examined Japanese Patent Application No. 6031/65: published unexamined Japanese Patent Application Nos. 20826/76, 58922/77, 129538/74, 74027/74, 159336/75, 42121/77, 74028/74, 60233/75, 26541/76, 55122/78 and 35858/82: and so on.

Yellow couplers which can be employed to advantage include benzoylacetoanilide compounds and pivaloylacetoanilide compounds. Specific examples of employable yellow couplers include those described in U.S. Pat. Nos. 2,875,057; 3,265,506; 3,408,194; 3,551,155; 3,582,322; 3,725,072 and 3,891,445: German Pat. No. 1,547,868; German Patent Application (OLS) Nos. 2,219,917; 2,261,361 and 2,414,006: British Pat. No. 1,425,020: published examined Japanese Patent Application No. 10783/76: published unexamined Japanese Patent Application Nos. 26133/72, 73147/73, 102636/76, 6341/75, 123342/75, 130442/75, 21827/76, 87650/75, 82424/77 and 115219/77: and so on.

Cyan couplers which can be employed include phenol compounds and naphthol compounds. Specific examples of such cyan couplers are described in U.S. Pat. Nos. 2,369,929; 2,434,272; 2,474,293; 2,521,908; 2,895,826; 3,034,892; 3,311,476; 3,458,315; 3,476,563; 3,583,971; 3,591,383; 3,767,411 and 4,004,929: German Patent Application (OLS) Nos. 2,414,830 and 2,454,329: and published unexamined Japanese Patent Application Nos. 59838/73, 26034/76, 5055/73, 146828/76, 69624/77 and 90932/77.

Colored couplers which can be employed include those described in U.S. Pat. Nos. 3,476,560, 2,521,908 and 3,034,892: published examined Japanese Patent Application Nos. 2016/69, 22335/63, 11304/67 and 32461/69: published unexamined Japanese Patent Nos. 26034/76 and 42121/77: and German Patent Application (OLS) No. 2,418,959.

DIR couplers which can be employed include those described in, for example, U.S. Pat. Nos. 3,227,554; 3,617,291; 3,701,783; 3,790,384 and 3,632,345: German Patent Application (OLS) Nos. 2,414,006; 2,454,301 and 2,454,329: British Pat. No. 953,454: published unexamined Japanese Patent Application Nos. 69624/77 and 122335/74: and published examined Japanese Patent Application No. 16141/76.

The sensitive materials of this invention may contain compounds capable of releasing development inhibitors at the time of development in addition to DIR couplers. For example, compounds described in U.S. Pat. Nos. 3,297,445 and 3,379,529: German Patent Application (OLS) No. 2,417,914: and published unexamined Japanese Patent Application Nos. 15271/77 and 9116/78 can be employed.

Two or more kinds of the above-described couplers may be incorporated in one layer, or the same compound may be incorporated in two or more of different layers.

Each of these couplers is added to a photographic emulsion layer in an amount ranging generally from $2\times10^{-3}$ mole to $5\times10^{-1}$ mole, and preferably from $1\times10^{-2}$ mole to $5\times10^{-1}$ mole, per 1 mole of silver in the emulsion.

In producing the photographic material of this invention, photographic emulsion layers and other hydrophilic colloidal layers can be coated on a support or other layers using various known coating methods. For example, a dip coating method, a roller coating method, a curtain coating method, an extrusion coating method and so on can be employed. The methods described in U.S. Pat. Nos. 2,681,294; 2,761,791 and 3,526,528 are employed to advantage.

Photographic processing of the sensitive material of this invention can be carried out according to any of the known methods, and known processing solutions can be employed. The processing temperature is generally selected from the range of 18° C. to 50° C. However, temperatures lower than 18° C. or higher than 50° C. may be adopted. When dye images are to be formed, any color development processing can be employed as circumstances demand.

The color developing solution is, in general, an alkaline aqueous solution containing a color developing agent. Color developing agents which can be employed are known primary aromatic amine developers such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above-described color developing agents, those described in L. F. A. Mason; *Photographic Processing Chemistry*, pp. 226–229, Focal Press, London (1966), U.S. Pat. Nos. 2,193,015 and 2,592,364: published unexamined Japanese Patent Application 64933/73, and so on may be employed.

Besides the above-described color developing agent, the color developing solution can contain a pH buffer such as alkali metal salts of sulfurous acid, carboxylic acid, boric acid and phosphoric acid, a development inhibitor or an antifoggant such as bromides, iodides and organic anti-foggants, and so on. Further, the color developing solution may optionally contain a water softener, a preservative like hydroxylamine, an organic solvent such as benzyl alcohol or diethylene glycol, a development accelerator such as polyethylene glycol, a quaternary ammonium salt or amines, dye forming couplers, competing couplers, a fogging agent like sodium borohydride, a viscosity providing agent, a chelating agent of polycarboxylic acid type described in U.S. Pat. No. 4,083,723; an antioxidant described in German Patent Application (OLS) No. 2,622,950; and so on.

After the color development, the photographic emulsion layers are usually subjected to a bleaching processing. The bleaching processing may be carried out simultaneously with a fixing processing, or separately from a fixing processing. Suitable examples of the bleaching agent which can be employed include compounds of polyvalent metals such as Fe(III), Co(III), Cr(VI), Cu(II) and the like, peroxy acids, quinones, nitroso compounds and so on. More specifically, ferricyanides, dichromates, Fe(III) or Co(III) complex salts of organic acids, for example, aminopolycarboxylic acids such as ethylenediaminetetraacetic acid, nitrilotriacetic acid, 1,3-diamino-2-propanol tetraacetic acid and the like, citric acid, tartaric acid, malic acid and so on; persulfates and permanganates; nitrosophenol; and so on. Of these compounds, potassium ferricyanide, sodium ethylenediaminetetraacetatoferrate (III) and ammonium ethylenediaminetetraacetatoferrate(III) are particularly useful. (Ethylenediaminetetraacetato)Fe(III) complexes are useful in both independent bleaching solutions and combined bleaching and fixing solutions.

To a bleaching solution or a combined bleaching and fixing solution, bleach accelerating agents as described in U.S. Pat. Nos. 3,042,520 and 3,241,966: published examined Japanese Patent Application Nos. 8506/70 and 8836/70: and so on, thiol compounds described in published unexamined Japanese Patent Application No. 65732/78, and other various additives can also be added.

The sensitive materials made in accordance with embodiments of this invention may be treated with developing solutions replenished or controlled for maintenance using the methods described in published unexamined Japanese Patent Application Nos. 119934/77, 46732/78, 9626/79, 19741/79, 1049/81 and 27142/81; and U.S. Pat. Nos. 4,089,760, 4,207,157, 4,283,266 and 4,313,808.

A bleaching and fixing solution to be employed for the sensitive materials made in accordance with embodiments of this invention may be that which has received such a recovering treatment as described in U.S. Pat. Nos. 3,634,088, 3,907,568, 4,014,764 and 4,013,527; published unexamined Japanese Patent Application Nos. 145231/75, and 144620/76; and published examined Japanese Patent Application No. 23178/76.

EXAMPLE 1

On a paper support both sides of which were laminated with polyethylene, were coated the layers from the first layer (the lowest layer) to the sixth layer (the topmost layer) described below to prepare a multilayer color sensitive material A. (The expression of mg/m$^2$ in the following table is a measure of coverage.)

| | | |
|---|---|---|
| The sixth layer (Protective layer) | Gelatin | 1500 mg/m$^2$ |
| The fifth layer (Red-sensitive layer) | Silver chlorobromide emulsion (containing 50 mol% of silver bromide and 250 mg/m$^2$ of silver) | |
| | Gelatin | 1500 mg/m$^2$ |
| | Cyan coupler (*1) | 500 mg/m$^2$ |
| | Coupler olvent (*2) | 250 mg/m$^2$ |
| The fourth layer (Ultra violet absorbing layer) | Gelatin | 1200 mg/m$^2$ |
| | Ultra violet absorbent (*3) | 700 mg/m$^2$ |
| | Ultra violet absorbent solvent (*2) | 250 mg/m$^2$ |
| The third layer (Green-sensitive layer) | Silver chlorobromide emulsion (containing 70 mol% of silver bromide and 350 mg/m$^2$ of silver) | |
| | Gelatin | 1500 mg/m$^2$ |
| | Magenta coupler (*4) | 400 mg/m$^2$ |
| | Coupler solvent (5*) | 400 mg/m$^2$ |
| The second layer (Interlayer) | Gelatin | 1000 mg/m$^2$ |
| The first layer (Blue sensitive layer) | Silver chlorobromide emulsion (containing 80 mol% of silver bromide and 350 mg/m$^2$ of silver) | |
| | Gelatin | 1500 mg/m$^2$ |
| | Yellow coupler (*6) | 500 mg/m$^2$ |
| | Coupler solvent (*2) | 500 mg/m$^2$ |
| Support | Polyethylene laminated paper (containing in the polyethylene laminate faced on the side of the first layer a white pigment (such as $TiO_2$, etc.) and a bluish dye (such as Ultramarine blue, etc.) | |

*1 Cyan coupler: 2-[α-(2,4-di-t-amylphenoxy)butanamido]-4, 6-dichloro-5-methylphenol.
*2 Couple solvent: Trinonylphosphate.
*3 Ultra violet absorbent: 2-(2-hydroxy-3-sec-butyl-5-t-butylphenyl)benzotriazole.
*4 Magenta coupler: 1-(2,4,6-trichlorophenyl)-3-[2-choro-5-tetradecanamido]anilino-2-pyrazolino-5-one.
*5 Coupler solvent: o-Cresylphosphate
*6 Yellow coupler: α-pivaloyl-α-(2,4-dioxo-5,5-dimethyloxazolidine-3-yl)-2-chloro-5-[α-(2,4-di-t-amylphenoxy)butanamido]acetanilide.

Sensitive materials B and C were prepared in the same manner as in the sensitive material A except that silver chlorobromide (containing 30% of Br) having a mean grain size of 0.05μ was incorporated so as to have a coverage of 50 mg/m$^2$ in the second layer or the fourth layer, respectively, of the sensitive material A. In addition, sensitive materials D, E and F were prepared in the same manner as described above except that the compound I-23 of this invention was dissolved in the coupler solvent (*2) together with the yellow coupler and coated so as to have a coverage of 20 mg/m$^2$ in the sensitive materials A, B and C, respectively.

Each of the above-described sensitive materials was exposed to light through an optical wedge, and subjected to the processings according to the steps described below.

| Processing Step (33° C.) | Time |
|---|---|
| Color development | 15 sec. to 3.5 min. |
| Bleaching and Fixing | 1.5 min. |
| Washing | 2 min. |
| Drying | 10 min. |

Processing solutions used in the above-described steps had the following compositions, respectively.

Composition of Color Developing Solution

| | |
|---|---|
| Benzyl alcohol | 12 ml |
| Diethylene Glycol | 5 ml |
| Potassium Carbonate | 25 g |

-continued

| | |
|---|---|
| Sodium Chloride | 0.1 g |
| Sodium Bromide | 0.5 g |
| Anhydrous sodium sulfite | 2 g |
| Hydroxyaminesulfate | 2 g |
| Brightening agent | 1 g |
| N—ethyl-N—β-methanesulfonamidoethyl 3-methyl-4-aminoaniline sulfate | 4 g |
| Water to make | 1 liter |
| NaOH to adjust to | pH 10 |

Composition of Bleaching and Fixing Solution

| | |
|---|---|
| Ammonium Thiosulfate | 124.5 g |
| Sodium Metabisulfite | 13.3 g |
| Anhydrous Sodium Sulfite | 2.7 g |
| Ammonium Ethylenediaminetetraacetato-ferrate(III) | 65 g |
| Color Developing Solution (described above) | 100 ml |
| pH adjusted to | 6.7–6.8 |
| Water to make | 1 liter |

The reflection densities of rays corresponding to yellow, magenta and cyan colors were measured using a Fuji type of self-recording densitometer.

Results obtained are shown in Table 1.

TABLE 1

| Sample | Fine Grain Emulsion | 3-Pyrazolidone | | $D_{max}$ at Each Developing Time 15" | 30" | 1'00" | 3'30" |
|---|---|---|---|---|---|---|---|
| A | — | — | Y | 0.30 | 1.03 | 1.81 | 2.20 |
| | | | M | 0.51 | 1.81 | 2.32 | 2.54 |
| | | | C | 1.28 | 2.20 | 2.56 | 2.60 |
| B | The Second Layer | — | Y | 0.32 | 1.08 | 1.86 | 2.21 |
| | | | M | 0.53 | 1.83 | 2.37 | 2.53 |
| | | | C | 1.30 | 2.22 | 2.58 | 2.60 |
| C | The Fourth Layer | — | Y | 0.32 | 1.06 | 1.85 | 2.20 |
| | | | M | 0.54 | 1.84 | 2.37 | 2.55 |
| | | | C | 1.31 | 2.21 | 2.59 | 2.59 |
| D | — | I - 23 | Y | 1.06 | 1.54 | 1.98 | 2.21 |
| | | | M | 1.40 | 2.25 | 2.40 | 2.56 |
| | | | C | 1.98 | 2.32 | 2.57 | 2.59 |
| E (This Invention) | The Second Layer | I - 23 | Y | 1.34 | 1.78 | 2.15 | 2.20 |
| | | | M | 1.89 | 2.45 | 2.50 | 2.56 |
| | | | C | 2.21 | 2.44 | 2.58 | 2.60 |
| F (This Invention) | The Fourth Layer | I - 23 | Y | 1.40 | 1.80 | 2.18 | 2.22 |
| | | | M | 1.90 | 2.43 | 2.51 | 2.55 |
| | | | C | 2.22 | 2.45 | 2.59 | 2.60 |

Table 1 clearly shows this improved unexpected synergistic effect obtained by the present invention. The resulting developing effects are much better than might be expected as a result of using a fine grain emulsion or compound I-23 independently (especially at the initial stage of development, i.e., at a developing time of 30" to 60"). The improved synergistic results were obtained by incorporating both the fine grain emulsion and compound I-23 in the sensitive material. The improved results were particularly noticeable in the yellow layer.

EXAMPLE 2

Sensitive materials G to N were prepared in the same manner as sensitive material D or E except that four different 3-pyrazolidones were incorporated instead of the compound I-23, respectively.

Each of these sensitive materials were subjected to exposure, processings and reflection density measurement in the same manner as in Example 1. The results of density measurements of the yellow layers which had especially large effects are shown in Table 2.

It is apparent from Table 2 that the samples K, L, M and N (sensitive materials of this invention) showed remarkable development-accelerating effects (especially at the initial stage of development until 60").

TABLE 2

| Sample | Fine Grain Emulsion | 3-Pyrazolidone | $D_{max}$ (Y) 15" | 30" | 1'00" | 3'30" |
|---|---|---|---|---|---|---|
| A | — | — | 0.30 | 1.03 | 1.81 | 2.20 |
| G | — | I - 1 | 0.92 | 1.42 | 1.89 | 2.14 |
| H | — | I - 4 | 0.88 | 1.40 | 1.90 | 2.15 |
| I | — | I - 14 | 0.98 | 1.50 | 1.95 | 2.22 |
| J | — | I - 24 | 1.07 | 1.58 | 2.00 | 2.21 |
| K | The Second Layer | I - 1 | 1.19 | 1.65 | 2.05 | 2.17 |
| L | The Second Layer | I - 4 | 1.15 | 1.61 | 1.99 | 2.18 |
| M | The Second Layer | I - 14 | 1.30 | 1.70 | 2.10 | 2.21 |
| N | The Second Layer | I - 24 | 1.37 | 1.80 | 2.15 | 2.20 |

What is claimed is:

1. A silver halide color photographic material, comprising: a support base having thereon; a substantially light-insensitive silver halide emulsion in a hydrophilic collodial layer which does not contain any light-sensitive silver halide; a light-sensitive silver halide emulsion layer; a color coupler and a compound represented by the following general formula (I):

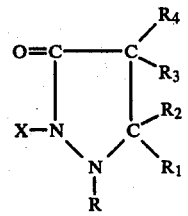

(I)

wherein X is H or an acetyl group; R is an aryl group; and $R_1$, $R_2$, $R_3$ and $R_4$ independently represent a hydrogen atom, an alkyl group or an aryl group.

2. A silver halide color photographic material, as claimed in claim 1, wherein the light-insensitive silver halide emulsion is comprised of a substantially light-insensitive silver halide with a halogen composition comprising 98 to 100% bromine 0 to 2% iodine, and the residual percent of chlorine.

3. A silver halide color photographic material as claimed in claim 2, wherein the light-insensitive silver halide is contained in a emulsion in a form of grains having an average size of 0.01 to 0.3μ.

4. A silver halide color photographic material as claimed in claim 3, wherein the light-sensitive silver halide emulsion is present on the support in an amount of 5 to 500 mg/m$^2$.

5. A silver halide color photographic material as claimed in claim 1, wherein the compound of general formula (I) is a compound wherein $R_1$, $R_2$, $R_3$ and $R_4$ each is an aryl group or a substituted alkyl group.

6. A silver halide color photographic material as claimed in claim 1, wherein X is a hydrogen atom.

7. A silver halide color photographic material as claimed in claim 1, wherein R is a phenyl group.

8. A silver halide color photographic material as claimed in claim 1, wherein $R_1$ and $R_2$ are phenyl groups and $R_3$ and $R_4$ are an alkyl group having 1 to 5 carbon atoms, said alkyl group being substituted with an acyloxy groups.

9. A silver halide color photographic material as claimed in claim 1, wherein the compound represented by the general formula (I) is present in an amount of 0.001 to 1 mol per mol of silver halide.

10. A silver halide color photographic material as claimed in claim 9, wherein the compound represented by the general formula (I) is present in an amount of 0.005 to 0.5 mol per mol of silver halide.

11. A silver halide color photographic material as claimed in claim 1, further comprising a subbing layer positioned on the support base, the subbing layer containing the compound represented by the general formula (I).

* * * * *